US005630850A

United States Patent [19]

Schafflützel et al.

[11] Patent Number: 5,630,850

[45] Date of Patent: May 20, 1997

[54] PROCESS FOR PRINTING FIBRE MATERIAL BY THE DIRECT PRINTING PROCESS

[75] Inventors: Paul Schafflützel, Basel, Switzerland; Philippe Ouziel, Altkirch, France

[73] Assignee: Ciba-Geigy Corporation, Tarrytown, N.Y.

[21] Appl. No.: 656,551

[22] Filed: May 31, 1996

Related U.S. Application Data

[63] Continuation of Ser. No. 376,499, Jan. 23, 1995, abandoned.

[30] Foreign Application Priority Data

Jan. 26, 1994 [CH] Switzerland ..... 231/94

[51] Int. Cl.[6] ..... D06P 1/46; D06P 1/52; D06P 1/382

[52] U.S. Cl. ..... 8/549; 8/555; 8/558; 8/563; 8/611; 8/617; 8/585

[58] Field of Search ..... 8/555, 557, 561, 8/562, 543, 549, 558

[56] References Cited

U.S. PATENT DOCUMENTS

| | | | |
|---|---|---|---|
| 4,304,567 | 12/1981 | Ballmann et al. | 8/543 |
| 4,585,820 | 4/1986 | Défago et al. | 524/232 |
| 5,002,587 | 3/1991 | Berendt | 8/543 |
| 5,147,410 | 9/1992 | Heindl et al. | 8/555 |

FOREIGN PATENT DOCUMENTS

| | | |
|---|---|---|
| 0077297 | 4/1983 | European Pat. Off. . |
| 0457728 | 11/1991 | European Pat. Off. . |

OTHER PUBLICATIONS

Ciba–Geigy, "Verdickungsmittel fürDruckpasten Zum Bedrucken van farbstoffaffinen Material," Research Disclosure 307, 789 Nov. 1989.

*Primary Examiner*—Margaret Einsmann
*Attorney, Agent, or Firm*—Kevin T. Mansfield

[57] ABSTRACT

There is disclosed a process for printing fibre material by the direct printing process, which process comprises printing the fibre material with a print paste comprising at least one dye, one cellulose derivative or alginate as thickener as well as further customary assistants and wherein the print paste comprises ≦5% by weight, based on the print paste, of a homopolymer or copolymer based on acrylamide.

The novel process makes it possible to obtain strong patterned prints on a white ground which have good levelness, good fastness properties and sharp contours. The print pastes are distinguished by good homogeneity, good storage stability and simple handling.

9 Claims, No Drawings

PROCESS FOR PRINTING FIBRE MATERIAL BY THE DIRECT PRINTING PROCESS

This application is a continuation of application Ser. No. 08/376,499, filed Jan. 23, 1995, now abandoned.

The present invention relates to a process for printing fibre material such as cellulosic textile material, wool, silk or synthetic fabric such as polyester or polyamide by the direct printing process, and to the print paste used therefor.

It has long been known to print fibre materials with print pastes comprising cellulose derivatives or, in particular, alginates as thickeners. To ensure sufficient surface coating or levelness of print, the print paste must penetrate the fabric. However, if penetration is too deep, or if too much print paste is applied, this may result in "flushing" of the prints so obtained. Also, it has often been observed that the deep and possibly non-uniform penetration of the print paste results in unlevel prints or dichroism. Moreover, the prints of the prior art often exhibit insufficient contour definition.

Accordingly, it is the object of the present invention to provide print pastes using the standard thickeners, which pastes do not have the above-mentioned disadvantages and which give prints having, in particular, excellent contour definition without adversely affecting the handle of the printed fabric. Surprisingly, this object is achieved by adding to the print paste small amounts of an acrylamide homopolymer or copolymer.

Accordingly, the present invention relates to a process for printing fibre material by the direct printing process which comprises applying to the fibre material a print paste containing at least one dye, one cellulose derivative or one alginate as thickener as well as further customary assistants, and subsequently fixing the dye, said print paste comprising ≦5% by weight, based on the print paste, of an acrylamide homopolymer or copolymer.

The acrylamide homopolymer and copolymers used in the process of this invention have an average molecular weight of typically 0.5 to 15 million, preferably of 1 to 10 million, more particularly of 1 to 5 million and, most preferably, of 1 to 2.5 million. Suitable acrylamide homopolymers or copolymers are those consisting of acrylamide and one or more than one comonomer.

Typical examples of such comonomers are:

Monomers having a carboxyl function:

(meth)acrylic acid, maleic acid, fumaric acid, iraconic acid, mesaconic acid, citraconic acid, vinylacetic acid, vinyloxyacetic acid, vinylpropionic acid, crotonic acid, aconitic acid, allylacetic acid, allyloxyacetic acid, α,β-dimethylacrylic acid, allylmalonic acid, allyloxymalonic acid, methylenemalonic acid, 2-hydroxy(meth)acrylic acid, 2-halo(meth)acrylic acid, α-ethylacrylic acid, acrylamidoglycolic acid, glutaconic acid, β-carboxyethylacrylate, allyloxy-3-hydroxybutanoic acid and allylsuccinic acid.

Monomers containing a phosphoric acid group: vinylphosphonic acid, (meth)allylphosphonic acid and acrylamidomethylpropanephosphonic acid.

Monomers containing a sulfonic acid group:

(meth)acrylamidomethanesulfonic acid, vinylsulfonic acid, (meth)allylsulfonic acid, 2-acrylamido-2-methylpropanesulfonic acid, 3-(meth)acrylamidopropanesulfonic acid, 3-sulfopropyl(meth)acrylate, bis(3-sulfopropylitaconate), 4-styrenesulfonic acid and 3-allyloxy-2-hydroxypropylsulfonic acid.

Nitrogen-containing and nonionic comonomers:

N-vinylpyrrolidone, N-vinylformamide, N-vinyl-N-methylformamide, N-vinylacetamide, N-vinyl-N-methylacetamide, N-vinyl-N-ethylacetamide, N-vinylimidazole, N-vinyl-N-methylimidazole, N-vinylimidazoline, N-vinyl-2-methylimidazoline, N-vinylcaprolactam, vinyl acetate, vinyl propionate, vinyl butyrate, $C_1$–$C_{22}$alkylvinyl ketone, $C_1$–$C_{22}$alkylvinyl ethers, olefins (ethylene, propylene, isobutene), 1,2-dimethoxyethylene, styrene derivatives, hyclroxyethyl/propyl/butyl/(meth)acrylate, $C_1$–$C_4$alkyl(meth)acrylates, (meth)acrolein, (meth)acrylonitrile, methacrylamide, ester/(subst.) amides/nitriles of the monomers having a carboxyl function, N-mono/N-disubstituted (meth)acrylamide, $C_1$–$C_4$alkoxy(meth)acrylates, $EO_x$-$PO_y$-$ButO_z$ where x,y,z=0–250, $C_5$–$C_{22}$alkyl(meth)acrylates, N-mono/disubstituted $C_5$–$C_{22}$acrylamides, $C_5$–$C_{22}$alkylvinyl ethers, $C_5$–$C_{22}$alkylvinyl ketones and dimethyl/diethylaminoethyl/propyl/butyl(meth)acrylates in the form of the salts or in quaternised form, suitable quaternising agents being typically dimethyl/ethyl sulfate, methyl/ethyl chloride or benzyl chloride.

Preferred polymers used in the novel print paste are acrylamide homopolymers or copolymers consisting of acrylamide and acrylic acid or N-methyl-N-vinylacetamide.

In a preferred embodiment of the present invention an acrylamide homopolymer having an average molecular weight of 0.5 to 15 million, preferably of 1 to 10 million, is added to the print paste.

A further preferred embodiment of the present invention relates to the addition of a copolymer consisting of acrylamide and acrylic acid having an average molecular weight of typically 0.5 to 15 million, preferably of 1 to 10 million and, most preferably, of 1.5 to 3 million, to the print paste. The preferred copolymers consist of 30 to 99.9% by weight of acrylamide and 0.1 to 70% by weight of acrylic acid, each based on the weight of the monomers. Most preferred is the use of acrylamide/acrylic acid copolymers having an acrylamide content of >60% by weight, based on the weight of the monomers. A very particularly preferred embodiment of the present invention relates to the use of copolymers consisting of 75 to 90% by weight of acrylamide and 10 to 25% by weight of acrylic acid, in each case based on the weight of the monomers.

A further preferred embodiment of the present invention relates to the use of a copolymer consisting typically of 30 to 99.9% by weight of acrylamide and 0.1 to 70% by weight of N-vinyl-N-methylacetamide, each based on the weight of the monomers, as assistants to the print paste. Preferred copolymers are those consisting of 40 to 60% by weight of acrylamide and 60 to 40% by weight of N-vinyl-N-methylacetamide, and most preferred copolymers are those consisting of 50% by weight of acrylamide and 50% by weight of N-vinyl-N-methylacetamide, each based on the weight of the monomers. The acrylamide/N-vinyl-N-methylacetamide copolymers may additionally contain a minor amount, typically ≦10% by weight, based on the weight of the acrylamide or N-vinyl-N-methylacetamide monomers, of an alkoxylated fatty alcohol, for example a polyadduct of ethylene oxide and/or propylene oxide with glycerol which addition is conveniently made during the synthesis of the copolymers.

The homopolymer and copolymers used in the process of this invention are known or can be prepared by methods known per se.

The acrylamide homopolymer or copolymer is added to the print paste preferably in a concentration of ≦1% by weight, most preferably of <0.5% by weight, in each case based on the weight of the print paste. Too high a concentration of polymer may limit printability and adversely affect the handle of the fabric. In a particularly preferred embodiment of this invention, the process is carried out in the presence of 0.002 to 1 % by weight, preferably of 0.01 to 0.5% by weight, of acrylamide homopolymer or copolymer, in each case based on the print paste.

The print paste of this invention contains as thickener a conventional cellulose derivative, typically a cellulose ether such as methyl cellulose, ethyl cellulose, hydroxyethyl cellulose, methylhydroxyethyl cellulose, hydroxypropyl cellulose, hydroxypropylmethyl cellulose, carboxymethyl cellulose, carboxyethyl cellulose or cyanoethyl cellulose or a cellulose ester such as acetyl cellulose or, preferably, an alginate, typically sodium alginate. The amount of thickener in the print paste may vary over a wide range, depending on the desired viscosity; it is preferred to use e.g. 10 to 100 g/kg, most preferably 15 to 70 g/kg, of print paste.

In addition, the print paste may contain customary assistants such as hydrotropic agents, defoamers and deaerators, antireducing agents, preservatives, sequestrants or bases.

If the print paste contains a hydrotropic agent, then this is preferably urea in an amount of typically 0.1 to 20% by weight, preferably of 0.1 to 10% by weight, based on the finished print paste.

Deaerators may be any commercial deaerators, provided the rheological properties of the novel print paste are not adversely affected. Owing to their good defoaming properties, suitable deaerators are preferably those of low to no silicone oil content, generally containing contain generally 0 to about 5 percent by weight, preferably 0.1 to 1 percent by weight, of a conventional silicone oil.

Preferred deaerators typically contain as active ingredient high-boiling hydrocarbons, hydrogenated naphthalenes, mineral oils, fatty oils or insoluble metal soaps or mixtures thereof, and they may contain the amount of silicone oil specified above. They may, however, also be in the form of aqueous solutions that usually contain a nonionic surfactant, typically an ethylene oxide adduct with an alkyl phenol or sorbitan stearate, in addition to the active ingredients of the indicated kind. Preferred components or active ingredients of the deaerators are higher alcohols with boiling points above c. 100° C., terpentine oils, mineral oils or mixtures thereof. It is preferred to use mixtures of hydrocarbons which normally have a flash point of above c. 120° C., preferably of c. 150 ° to 220° C., and a boiling range from c. 250° to 500° C. under normal conditions.

Particularly interesting deaerators are those containing as active ingredient a higher alcohol, typically 2-ethyl-n-hexanol or 2-hexyldecanol or mixtures thereof with high-boiling hydrocarbons, and having the indicated content of silicone oils. Said alcohols or alcohol/hydrocarbon mixtures may be in the form of aqueous formulations which, in addition to the active ingredients, usefully contain a surfactant, typically a polyadduct of ethylene oxide with an alkyl phenol having 6 to 12 carbon atoms in the alkyl moiety or a polyadduct of ethylene oxide with a sorbitan tristearate.

The print paste conveniently contains the deaerator in an amount of ≦5% by weight, preferably of 0.1 to 1% by weight, based on the weight of the finished print paste.

Suitable antireducing agents may be aromatic nitro compounds, preferably salts of aromatic mono- or dinitrocarboxylic or mono- or dinitrosulfonic acids which may be in the form of alkylene oxides, preferably alkali metal salts of a nitrobenzenesulfonic acid, conveniently sodium 2-nitrobenzenesulfonate. It is preferred to add an antireducing agent to the novel print paste, typically in an amount of 0.1 to 4% by weight, preferably of 0.8 to 2% by weight, based on the finished print paste.

Suitable preservatives are all conventional preservatives, for example chloroacetamide or formaldehyde. Suitable sequestrants are typically phosphates such as sodium hexametaphosphate.

If the print paste contains bases, for example for fixing the reactive dyes in the reactive print, then suitable bases are sodium carbonate, sodium hydroxide, disodium phosphate, trisodium phosphate, sodium acetate, sodium propionate, sodium hydrogencarbonate, aqueous ammonia or alkali donors such as sodium trichloroacetate or sodium formate. A mixture of sodium silicate and a 25% aqueous solution of sodium carbonate can also be used as fixing alkali. The pH of the print paste containing fixing alkali is normally in the range from 7.5 to 13.2, preferably from 8.5 to 12.5. When preparing the print paste, the amount of fixing alkali is chosen such that the pH of the ready-for-use print paste is in the alkaline range, preferably from pH 7.5 to 12. Accordingly, the amount of the fixing alkali may vary over a wide range, typically from 0.5 to 10% by weight, based on the finished print paste.

The dyes used in the process of this invention are those conventionally employed for dyeing or printing textile materials, as described, inter alia, in Colour Index, 3rd edition 1971 and in the supplements thereof under the headings "Reactive dyes", "Acid dyes", "Mordant dyes", "Vat dyes" or "Disperse Dyes".

It is preferred to use reactive dyes for printing cellulosic fibre materials. These reactive dyes are dyes of different classes, typically those of the monoazo or polyazo series, metal complex azo, anthraquinone, phthalocyanine, formazan, or dioxazine series which contain at least one reactive group.

Reactive groups will be understood as meaning fibre-reactive radicals that are able to react with the hydroxy groups of cellulose, the amino, carboxyl, hydroxyl and thiol groups of wool and silk, or with the amino and, where present, the carboxyl group of synthetic polyamides to form covalent chemical bonds. The reactive groups are usually bonded direct or through a bridge member to the dye radical. Suitable reactive groups are typically those that contain at least one removable substituent at an aliphatic, aromatic or heterocyclic radical or wherein the cited radicals contain a radical suitable for reaction with the fibre material, typically a halotriazinyl radical, halopyrimidinyl radical or vinyl radical.

Preferred aliphatic reactive groups are those of formulae —$SO_2Z$, —$SO_2$—NH—Z, —NH—CO-alk-$SO_2Z$, —CO—NH-alk-$SO_2Z$, or —NH—CO—$Z_1$, wherein Z is a leaving group, typically β-sufatoethyl, β-thiosulfatoethyl, β-phosphatoethyl, β-acyloxyethyl, β-haloethyl or vinyl, $Z_1$ is typically a α,β-dihaloethyl or α-haloethenyl radical, alk is $C_2$–$C_4$alkylene, and halogen is preferably chloro or bromo.

Preferred heterocyclic, fibre-reactive radicals are 1,3,5-triazine radicals of formula

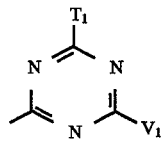

wherein $T_1$ is fluoro, chloro or carboxypyridinium, and substituents Vat the triazine ring are in particular: fluoro or chloro; —$NH_2$, unsubstituted or substituted alkylamino groups or N,N-dialkylamino groups, for example unsubstituted or hydroxy-, sulfo- or sulfato-substituted N-mono- or N,N-di-$C_1$–$C_4$alkylamino; cycloalkylamino; aralkylamino, typically benzylamino; arylamino groups such as unsubstituted or sulfo-, methyl-, methoxy- or chloro-substituted phenylamino; mixed substituted amino groups such as N-alkyl-N-cyclohexylamino groups or N-alkyl-N-phenylamino groups; and morpholino.

Preferred reactive dyes for the process of this invention are those containing at least one monohalotriazine group, preferably one monochlorotriazine group.

It is also possible to use dyes having two or more than two identical or different reactive groups.

The amount of the dyes is usually determined by the desired tinctorial strength and is conveniently from 0.01 to 400 g/kg, advantageously from 0.5 to 300 g/kg and, preferably, from 1 to 200 g/kg of print paste.

The print paste of this invention is novel and is a further object of the invention.

In its preferred embodiment the print paste comprises

| | |
|---|---|
| 0.001 to 40% by weight | of dye, |
| 1 to 7% by weight | of cellulose derivative or alginate as thickener, |
| 0.002 to 5% by weight | of acrylamide homopolymer or copolymer, |
| 0 to 4% by weight | of antireducing agent, |
| 0 to 5 by weight | of defoamer or deaerator, |
| 0 to 20% by weight | of urea, |
| 0 to 10 by weight | of fixing alkali |
| and water to make up 100% by weight. | |

A print paste which is particularly preferred for printing cellulosic fibre materials by reactive dye printing comprises

| | |
|---|---|
| 0.05 to 30% by weight | of dye, |
| 1 to 7% by weight | of alginate, |
| 0.002 to 1% by weight | of acrylamide homopolymer or copolymer, |
| 0.8 to 2% by weight | of antireducing agent, |
| 0.1 to 1% by weight | of deaerator, |
| 0.1 to 20% by weight | of urea, |
| 0.5 to 10% by weight | of fixing alkali, |
| and water to make up 100% by weight. | |

A print paste which is very particularly preferred for printing cellulosic fibre materials by reactive dye printing comprises

| | |
|---|---|
| 0.1 to 20% by weight | of dye, |
| 1.5 to 2.5% by weight | of sodium alginate, |
| 0.01 to 1% by weight | of acrylamide/acrylic acid copolymer, |
| 0.8 to 2% by weight | of alkali metal salt of pure nitrobenzenesulfonic acid as antireducing agent |
| 0.1 to 1% by weight | of deaerator based on a higher alcohol, typically 2-ethyl-n-hexanol or 2-hexyl decanol, |
| 0.1 to 10% by weight | of urea, |
| 0.5 to 10% by weight | of fixing alkali, |
| and water to make up 100% by weight. | |

The novel print pastes are prepared in simple manner by mixing the components, adding the requisite amount of water at the conclusion for adjustment to a viscosity suitable for direct printing, in the range from, for example, 1500 to 10000 mPa.s, preferably from 1500 to 7000 mPa.s.

The novel print paste is distinguished by good homogeneity, excellent storage properties and ease of handling.

For printing, the print paste is applied to the entire surface of the substrate, preferably in patterned form, using printing machines of conventional make, typically rotary screen and flat screen printing machines.

After application of the print paste, the printed textile material is preferably dried and then subjected to a heat treatment to finish the print and to fix the dye.

The heat treatment can be carried out by a hot dwell process, a thermosol process or, preferably, by a steam process.

In the steam process, the printed textile materials are subjected to treatment in a steamer with steam or superheated steam, conveniently in the temperature range from 98 to 210° C., preferably from 100° to 180° C. and, most preferably, from 100 ° to 120° C.

Finishing the prints by the thermosol process can be carried out with or without intermediate drying, typically in the temperature range from 100° to 210° C. It is preferred to carry out the thermosol process in the temperature range from 120° to 210° C., preferably from 140° to 180° C. and, after subjecting the printed goods to an intermediate drying, at 80° to 140° C. Depending on the temperature, the thermosol treatment can take from 20 seconds to 5 minutes, preferably from 30 seconds to 4 minutes.

After the printing process, the textile material is given a conventional washing-off to remove unfixed dye by treating the substrate at e.g. 40° C. to boiling temperature in a solution which may contain soap or a synthetic detergent.

The fibre materials to be printed are, for example, textile materials consisting of natural, semi-synthetic or synthetic fibres; mixtures of these fibres are also suitable. The semi-synthetic fibres are typically regenerated cellulose fibres such as viscose fibres or acetate fibres (secondary acetate and triacetate) and the synthetic fibres are mainly polyacrylonitrile, polyamide or polyester fibres. Suitable natural fibres are typically silk, wool or natural cellulose, in particular cotton.

The process of this invention is particularly suitable for printing a) fibre materials of regenerated or, in particular, natural cellulose, such as viscose, cellulose acetate, hemp, linen, jute or cotton with reactive dyes;

b) polyester materials with disperse dyes, and c) cellulose-containing blends, for example polyamide/cotton or polyester/cotton with reactive and disperse dyes.

The process is very particularly suitable for printing viscose, cotton or cotton/polyester blends. In the latter case, the cotton and polyester component may conveniently be printed simultaneously with a mixture of reactive dye and disperse dye.

The fibre material consists primarily of flat textile structures such as bonded fibre fabrics, felts, carpets, knitted and, preferably, woven fabrics. The novel process is suitable for fibre materials which may be pretreated with sodium hydroxide solution, for cellulosic material and regenerated cellulose such as viscose cellulose or blends thereof.

With the novel process it is possible to obtain tinctorially strong patterned prints on a white ground which have good levelness and good fastness properties such as fastness to light, washing and rubbing. The prints also exhibit almost no dichroism. It is to be particularly highlighted that the contour definition of the prints obtained by this process is greatly enhanced in comparison to processes without addition of acrylamide homopolymer or compolymer. A further advantage relates to the comparatively low penetration of the dye into the textile material in the process of this invention, i.e. the print obtained is a surface print, so that it is possible to prepare a predefined tinctorial strength with reduced print paste add-on.

In the following Examples percentages are by weight, unless otherwise stated.

EXAMPLE 1

A bleached mercerised cotton fabric is pattern-printed on a flat screen printing machine with a print paste of the following composition:

| | |
|---|---|
| 70 g/kg | of a commercial liquid formulation of the dye of formula |

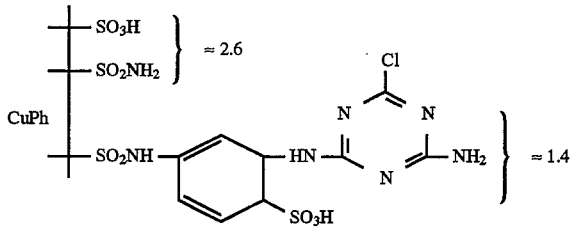

| | |
|---|---|
| 10 g/kg | of sodium 2-nitrobenzenesulfate, |
| 75 g/kg | of a 20% aqueous solution of calc. $Na_2CO_3$, |
| 480 g/kg | of medium viscosity sodium alginate (6% batch containing 5 g/kg of sodium hexametaphosphate and 5 g/kg of 37% formaldehyde), |
| 100 g/kg | of urea |
| 75 g/kg | of a 0.8% aqueous solution of a copolymer of c. 15% acrylic acid and 85% acrylamide, molecular weight c. 2 million, |
| 3 g/kg | of a deaerator, based on 2-ethyl-n-hexanol, and |
| 187 g/kg | of water. |

The pH of the print paste is 10.7 and the viscosity is 5300 mPa.s, measured in a Brookfield RVT viscosity meter, spindle 6, 20 rpm at 25° C. The printed fabric is dried at 90° C. and, for fixing the dye, treated at 100° to 102° C. for 8 min with saturated steam. The fabric is then rinsed with cold and hot water until unfixed dye and the assistant are removed. After drying the fabric at 90° to 100° C., a strong level turquoise print with sharp contours is obtained, and the treated fabric also has a soft handle.

EXAMPLE 1A

Comparably good results are obtained by repeating the process of Example 1, but using a print paste comprising 480 g/kg of medium viscosity sodium alginate (6% batch containing 5 g/kg of sodium hexametaphosphate and 3 g/kg of 37% formaldehyde) instead of 480 g/kg of medium viscosity sodium alginate (6% batch containing 5 g/kg of sodium hexametaphosphate and 5 g/kg of 37% formaldehyde), 30 g/kg of a 1% aqueous solution of a copolymer of c. 15% acrylic acid and 85% of acrylamide (molecular weight c. 2 million) instead of 75 g/kg of a 0.8% aqueous solution of a copolymer of c. 15% acrylic acid and 85% of acrylamide (molecular weight c. 2 million) and 232 g/kg of water instead of 187 g/kg of water.

EXAMPLE 2

The process of Example 1 or 1A is repeated to print a bleached viscose fabric instead of the bleached mercerised cotton fabric, likewise giving a strong level turquois print with sharp contours and a soft handle.

EXAMPLE 3

The process of Example 1 is repeated, except that the bleached mercerised cotton fabric is printed with a print paste of the following composition:

| | |
|---|---|
| 30 g/kg | of a commercial liquid formulation of the dye of formula |

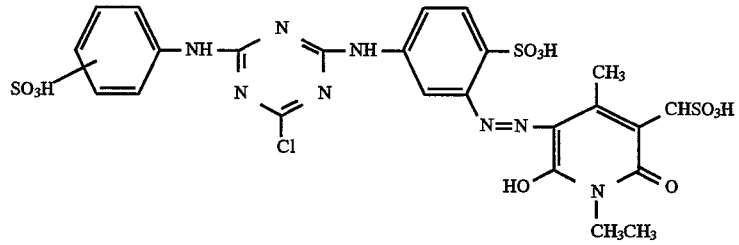

| | |
|---|---|
| 60 g/kg | of a commercial liquid formulation of the dye of formula |

-continued

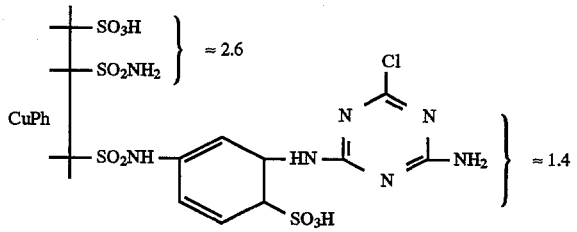

| | |
|---|---|
| 10 g/kg | of sodium 2-nitrobenzenesulfonate, |
| 75 g/kg | of a 20% aqueous solution of calc. $Na_2CO_3$, |
| 480 g/kg | of medium viscosity sodium alginate (6% batch comprising 5 g/kg of sodium hexametaphosphate and 5 g/kg of 37% formaldehyde) |
| 100 g/kg | of urea, |
| 75 g/kg | of a 0.8% aqueous solution of a copolymer of c. 15% acrylic acid and 85% of acrylamide, molecular weight c. 2 million, |
| 3 g/kg | of deaerator, based on 2-ethyl-n-hexanol, and |
| 167 g/kg | of water. |

The pH of the print paste is 10.7 and the viscosity is 5800 mPa.s, measured in a Brookfield RVT viscosimeter, spindle 6, 20 rpm at 25° C. A strong level green print with sharp contours is obtained and the treated fabric has a soft handle.

EXAMPLE 3A

Comparably good results are obtained by repeating the process of Example 3, but using a print paste comprising 480 g/kg of medium viscosity sodium alginate (6% batch containing 5 g/kg of sodium hexametaphosphate and 3 g/kg of 37% formaldehyde) instead of 480 g/kg of medium viscosity sodium alginate (6% batch, containing 5 g/kg of sodium hexametaphosphate and 5 g/kg of 37% formaldehyde), 30 g/kg of a 1% aqueous solution of a copolymer of c. 15% acrylic acid and 85% acrylamide (molecular weight c. 2 million) instead of 75 g/kg of a 0.8% aqueous solution of a copolymer of c. 15% acrylic acid and 85% of acrylamide (molecular weight c. 2 million and 212 g/kg of water instead of 167 g/kg of water.

EXAMPLE 4:

The process of Example 3 or 3A is repeated to print a bleached viscose fabric instead of a bleached mercerised cotton fabric, likewise giving a strong level green print with sharp contours and a soft handle.

EXAMPLe 5–7

The process of Example 1 is repeated, replacing the acrylamide/acrylic acid copolymer with the equivalent amount of one of following polymers, to give comparably good results:

acrylamide homopolymer having an average molecular weight of c.10 million;

mixture comprising 98 parts of a copolymer of c. 50% by weight of acrylamide and 50% by weight of methyl-N-vinylacetamide, based on the monomers, and 2 parts of a polyadduct of 71 propylene oxide units with glycerol;

copolymer of c. 70% by weight of acrylamide and 30% by weight of acrylic acid, average molecular weight >1 million.

EXAMPLE 8–11

The process of Examples 1, 1A or 2 is repeated, replacing the 70 g/kg of the phthalocyanine dye with the equivalent amount of one of the dyes listed below, to give comparably good results:

8

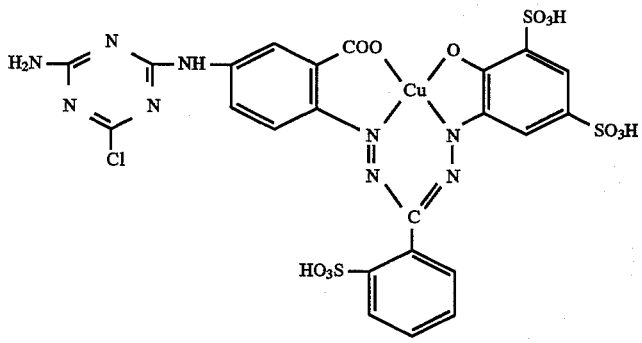

-continued

9

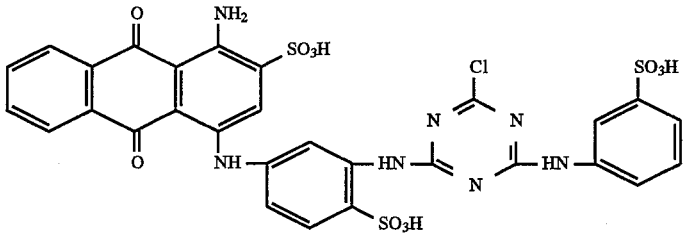

10

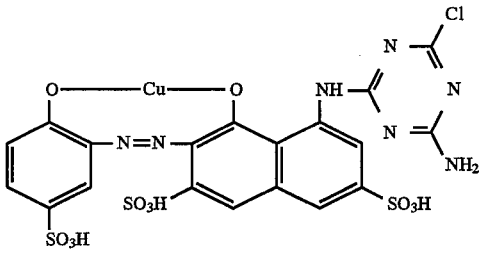

11

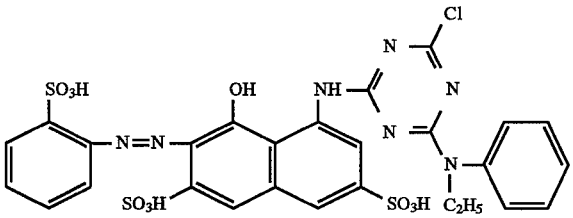

EXAMPLE 12

Bleached mercerised cotton fabric is pattern-printed on a flat screen printing machine with a print paste of the following composition:

| | |
|---|---|
| 80 g/kg | of a commercial liquid formulation of the dye of formula |

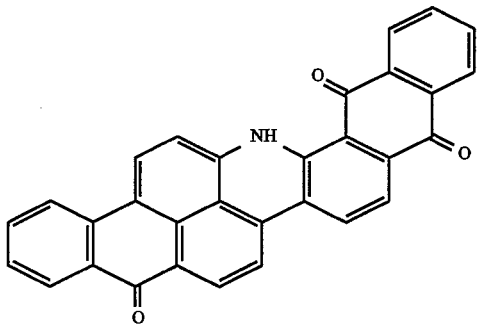

| | |
|---|---|
| 100 g/kg | of sodium hydroxymethanesulfinate, |
| 96 g/kg | of potassium carbonate ($K_2CO_3$), |
| 448 g/kg | of a 10% aqueous solution of starch ether, |
| 64 g/kg | of glycerol, |
| 20 g/kg | of a 1% aqueous solution of a copolymer of c. 15% acrylic acid and 85% of acrylamide, molecular weight c. 2 million, |
| 4 g/kg | of deaerator, based on 2-ethyl-n-hexanol, and |
| 188 g/kg | of water. |

The print paste has a viscosity of c. 5000 mPa.s, measured in the Brookfield RVT viscosimeter, spindle 6, 20 rpm at 25° C.

The printed fabric is dried at 70° to 80° C. and, for fixing the dye, treated for 10 min with saturated steam at 100° to 102° C. The fabric is rinsed with cold water and then treated for 5 min at 50° C. with 2 g/l of 35% H202 and 1 g/l of 80% acetic acid. Subsequently, the reoxidised fabric is rinsed with warm water, soaped for c. 5 min at the boil and then rinsed once more with warm and cold water. After drying the fabric at 60° to 100° C, a strong level olive print with sharp contours is obtained. The fabric also has a soft handle.

EXAMPLE 13

Polyester fabric is pattern printed on a flat screen printing machine with a print paste of the following composition:

| | |
|---|---|
| 50 g/kg | of a commercial liquid formulation of the dye of formula |

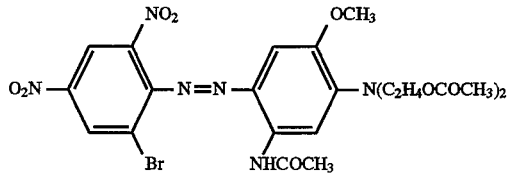

| | |
|---|---|
| 480 g/kg | of medium viscosity sodium alginate (6% batch, containing 5 g/kg of sodium hexametaphosphate and 3 g/kg of 37% formaldehyde), |
| 120 g/kg | of a 10% aqueous solution of starch ether, |
| 10 g/kg | of a 33% aqueous solution of $NaClO_3$, |
| 5 g/kg | of $NaH_2PO_4$, |
| 30 g/kg | of a 1% aqueous solution of a copolymer of c. 15% acrylic acid and 85% of acrylamide, molecular weight c. 2 million, |
| 3 g/kg | of deaerator, based on 2-ethyl-n-hexanol, and |
| 302 g/kg | of water. |

The print paste has a pH of 6.1 and the viscosity is c. 5400 mPa.s, measured on the Brookfield RVT viscosimeter, spindle 6, 20 rpm at 25° C.

The printed material is dried at c. 70° to 80° C. and, for fixing the dye, treated for c. 8 min with saturated steam at 175° C. for fixing. For finishing, the fabric is rinsed with cold water, soaped at 40° C. with 1 g/l of a nonionic fatty acid ethoxylate and then given a reductive afterclear at 40° to 70° C. with 1.5 g/l of $Na_2S_2O_4$, 2 g/l of sodium hydroxide solution 36°Bé and 1 g/l of said fatty acid ethoxylate. After rinsing the fabric again with warm and cold water and drying it, a strong level navy blue print with sharp contours is obtained. The treated fabric also has a soft handle.

EXAMPLE 14

Chlorinated wool fabric is pattern-printed on a flat screen printing machine with a print paste of the following composition:

| | |
|---|---|
| 25 g/kg | of the dye of formula |

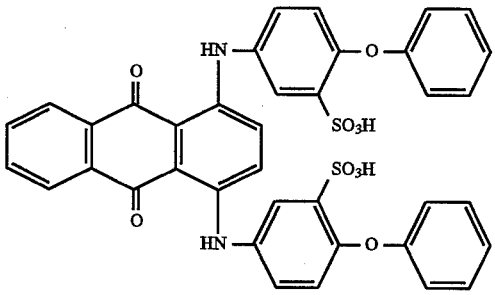

| | |
|---|---|
| 550 g/kg | of 8% locust bean gum or guar gum derivative, |
| 50 g/kg | of urea, |
| 50 g/kg | of Glyezin ® A (solvent), |
| 20 g/kg | of glycerol, |
| 60 g/kg | of ammonium tartrate 15° Bé, |
| 5 g/kg | of a 1% aqueous solution of a copolymer of c. 15% acrylic acid and 85% of acrylamide, molecular weight c. 2 million, |
| 5 g/kg | of Irgapadol ® PN new (antifreeze agent) |
| 3 g/kg | of deaearator, based on 2-ethyl-n-hexanol, and |
| 232 g/kg | of water. |

The printed fabric is dried at 70° to 80° C. and treated for 35 min with saturated stem at 100 to 102° C. to fix the dye. For finishing, the fabric is rinsed with cold water, soaped at 30° C. and rinsed again with cold water to give, after drying, a strong level green print with sharp contours. The treated fabric also has a soft handle.

What is claimed is:

1. A process for printing fibre material by the direct printing process, which process comprises applying to the fibre material a print paste comprising at least one dye, 10 to 100 g of an alginate per kg of print paste as thickener as well as further customary assistants, and subsequently fixing the dye, and wherein the print paste comprises ≦1% by weight, based on the print paste, of an acrylamide homopolymer having an average weight of 0.5 to 1 million of a copolymer of acrylamide and acrylic acid having an average molecular weight of 1 to 10 million.

2. A process according to claim 1, wherein the copolymer consists of 75 to 90% by weight of acrylamide and 10 to 25% by weight of acrylic acid, in each case based on the monomers.

3. A process according to claim 1, wherein the print paste comprises as customary assistants one or more than one component selected from the group consisting of hydrotropic agents, deaearators, antireducing agents, preservatives, sequestrants and bases.

4. A process according to claim 1, wherein the print paste comprises a higher alcohol having a boiling range of above 100° C., a terpentine oil, mineral oil or a mixture thereof as deaearator.

5. A process according to claim 1, wherein the print paste comprises urea as hydrotropic agent.

6. A process according to claim 1, wherein the print paste comprises an aromatic nitrogen compound as antireducing agent.

7. A process according to claim 1, wherein the print paste comprises

| | |
|---|---|
| 0.001 to 40% by weight % | of dye, |
| 1 to 7% by weight | of alginate as thickener, |
| 0.002 to 1% by weight | of acrylamide homopolymer or copolymer, |
| to 4% by weight | of antireducing agent, |
| to 5% by weight | of defoamer or deaerator, |
| to 20% by weight | of urea, |
| to 10% by weight | of fixing alkali, |
| and water to make up 100% by weight. | |

8. A process according to claim 1, wherein the fibre material is cellulosic fibre material.

9. A process according to claim 8, wherein at least one reactive dye containing a monochlorotriazine group is used as dye.

* * * * *